US006727639B2

(12) United States Patent
Lee

(10) Patent No.: US 6,727,639 B2
(45) Date of Patent: Apr. 27, 2004

(54) SHADOW MASK ASSEMBLY

(75) Inventor: Jae Wook Lee, Taejon-Kwangyokshi (KR)

(73) Assignee: LG Electronics Inc., Seoul (KR)

( * ) Notice: Subject to any disclaimer, the term of this patent is extended or adjusted under 35 U.S.C. 154(b) by 84 days.

(21) Appl. No.: 09/855,526

(22) Filed: May 16, 2001

(65) Prior Publication Data

US 2002/0036454 A1 Mar. 28, 2002

(30) Foreign Application Priority Data

May 17, 2000 (KR) ..... 2000-26438

(51) Int. Cl.[7] ..... H01J 29/80
(52) U.S. Cl. ..... 313/407; 313/402
(58) Field of Search ..... 313/402–408, 313/269; 445/37

(56) References Cited

U.S. PATENT DOCUMENTS 3,894,321 A * 7/1975 Moore ..... 445/30
4,737,681 A * 4/1988 Dietch et al. ..... 313/402
4,748,371 A * 5/1988 Bauder ..... 313/407
4,857,027 A * 8/1989 Makita et al. ..... 445/37
5,111,106 A * 5/1992 Kaplan et al. ..... 313/403
5,406,168 A * 4/1995 Takagi ..... 313/402
5,525,859 A * 6/1996 Ito et al. ..... 313/402
5,644,192 A * 7/1997 Ragland, Jr. ..... 313/402
5,672,935 A * 9/1997 Ito et al. ..... 313/406
6,054,803 A * 4/2000 Saita ..... 313/402
6,335,594 B2 * 1/2002 Park ..... 315/1
6,388,367 B1 * 5/2002 Taguchi ..... 313/402
6,479,925 B1 * 11/2002 Kim ..... 313/402

* cited by examiner

*Primary Examiner*—Ashok Patel
*Assistant Examiner*—Anthony Perry
(74) *Attorney, Agent, or Firm*—Fleshner & Kim, LLP

(57) ABSTRACT

The invention relates to a flat color CRT in which the upper plate width of a frame for tensioning and fixing a shadow mask is enlarged so that the CRT is free from an influence from howling of the shadow mask and welding and productivity of the shadow mask and the frame may be simplified. The shadow mask assembly comprises a shadow mask having an effective area with slots and a non-effective area without slots in the periphery; and a frame fixing body for tensioning the shadow mask; wherein the shortest distance $t_M$ from the outermost end of a main frame welded to the shadow mask to the interface between the effective area and the non-effective area and the width $t_W$ of the mask welding part formed at the upper part of the main frame have the relation of $$0.14 \le \frac{t_W}{t_M} \le 1.0.$$

12 Claims, 4 Drawing Sheets

SHADOW MASK ASSEMBLY

BACKGROUND OF THE INVENTION

1. Field of the Invention

The present invention relates to an improved frame structure for fixing a shadow mask in a flat color CRT(Cathode Ray Tube).

2. Description of the Related Art

In general, the flat color CRT is an apparatus for scanning electron beams to phosphor dots applied on a screen according to image information.

As shown in FIG. 1, the electron beams are color selected while passing through a shadow mask 10, which is formed of a thin film with a number of slots 11 and fixed at the rear of the screen by a frame structure.

The frame structure comprises main frames 20*a* directly welded to the shadow mask 10, and sub-frames 30 for supporting the lower parts of the main frames 20*a* while tensioning the same.

To be specific, the upper part of each of the main frames 20*a* defines a section perpendicular to the shadow mask 10 and the lower part is bent inwardly about the shadow mask in a right angle with the end reaching the perpendicular section so that the cross sectional configuration in the x-axis direction defines a triangle.

The sub-frames 30 are shaped as a bar. The shadow mask is tensioned and fixed to the frame structure according to the following process.

After the sub-frames 30 are welded to both end lower parts of the main frames 20*a*, when the main frames are forced so that the shadow mask 10 having a small amount of volume can be placed on the main frames, the sub-frames 30 are bent.

After the shadow mask 10 is welded to the upper parts of the main frames 20, when the force is released from the main frames 20*a*, the sub-frames 30 return to the original position while tensioning the shadow mask 10.

However, since the upper parts of the main frame perpendicular sections are very narrow, it is not easy to weld the shadow mask to the upper parts of the main frames and thus productivity is lowered.

Also, the main frames have a small amount of stiffness, and are easily deformed in tensioning the shadow mask so that the shadow mask may not be tensioned with a uniform tensile force.

Therefore, a resistant force generated to the shadow mask corresponding to the tensile force is distributed different according to the position so that the shadow mask has a low vibration frequency in a middle portion and a high vibration frequency at both ends thereby having a wide range of amplitude.

In other words, in use of the CRT, vibration from a speaker is amplified in a cabinet for defining a front outer case of the CRT and amplified vibration is transferred to a panel side of the CRT, then to the main frames and the shadow mask through springs in the frame.

When vibration transferred to the shadow mask is identical with the vibration frequency of the shadow mask, resonance takes place and slots tremble to distort the incident direction of the electron beams so that howling takes place to create stripes on the screen and definition is degraded.

SUMMARY OF THE INVENTION

It is therefore an object of the invention to provide a flat color CRT in which a frame structure for supporting a shadow mask in a shadow mask assembly is modified to simplify a welding operation and howling of the shadow mask is reduced to reproduce clean definition.

According to an embodiment of the invention to obtain the object, it is provided a shadow mask assembly comprising: a shadow mask having an effective area with slots and a non-effective area without slots in the periphery; and a frame fixing body for tensioning the shadow mask; wherein the shortest distance $t_M$ from the outermost end of a main frame welded to the shadow mask to the interface between the effective area and the non-effective area and the width $t_W$ of the mask welding part formed at the upper part of the main frame have the relation of $$0.14 \le \frac{t_W}{t_M} \le 1.0.$$

It is preferred that the shadow mask is welded to the outermost end of the main frame in the effective area side direction in the range of $t_W/2$ to $t_W$.

It is more preferred that the main frame and the shadow mask are weld in the range of $$0.30 \le \frac{t_M}{t_W} \le 0.99.$$

DETAILED DESCRIPTION OF THE PREFERRED EMBODIMENTS

Figure 1:
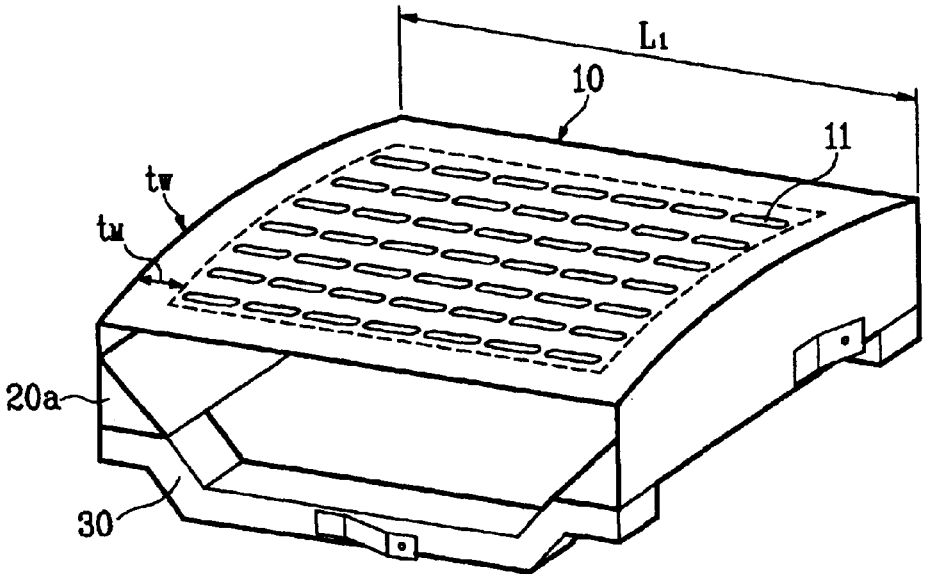
FIG.1 Related Art
FIG. 1 is a perspective view of a shadow mask assembly for showing a shadow mask fixed by a frame of the related art.

In description of the embodiment, the same elements are referred to by the same terms and the same reference numerals, and additional description thereof will be omitted hereinafter. The configuration of a flat color CRT of the invention will be described in reference to the appended drawings as follows.

Figure 2:
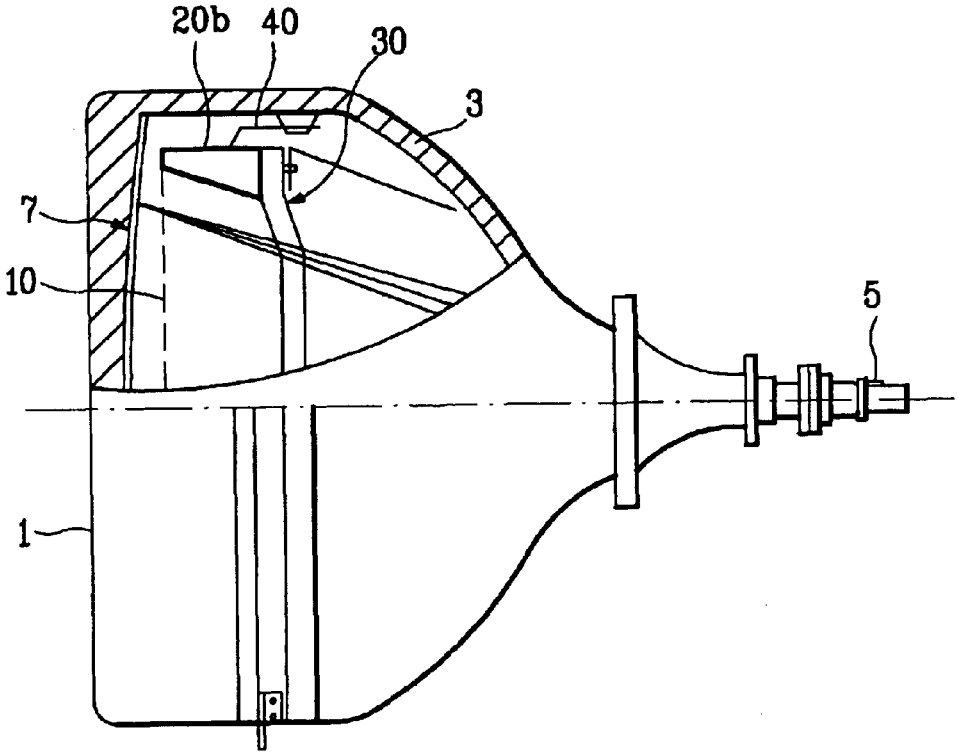
FIG. 2 is a cross sectional view for partially showing a flat color CRT mounted with a shadow mask assembly of the invention.

As shown in FIG. 2, the flat color CRT comprises a panel 1 having a phosphor screen 7 applied with R, G and B phosphor dots in the inner surface, a shadow mask 10 installed in a predetermined interval with the phosphor screen of the panel, and a funnel 3 for defining a space where electron beams can be projected.

When a sending side transmits an image signal decomposed into trichromatic elements of red, green and blue, the flat color CRT like this receives the image signal in an electron gun 5 enclosed at the rear of the funnel 3 and scans trichromatic electron beams to the rear side of the panel 1.

The electron beams are color selected while passing through slots of the shadow mask 10, and then land at the phosphor screen of the CRT lighting the phosphor dots of red, green and blue to reproduce the image.

The shadow mask 10 is formed of a thin film with a thickness of about 0.1 to 0.3 mm, and has a grill elongated in the direction of the slots 11 or tension.

Figure 3:
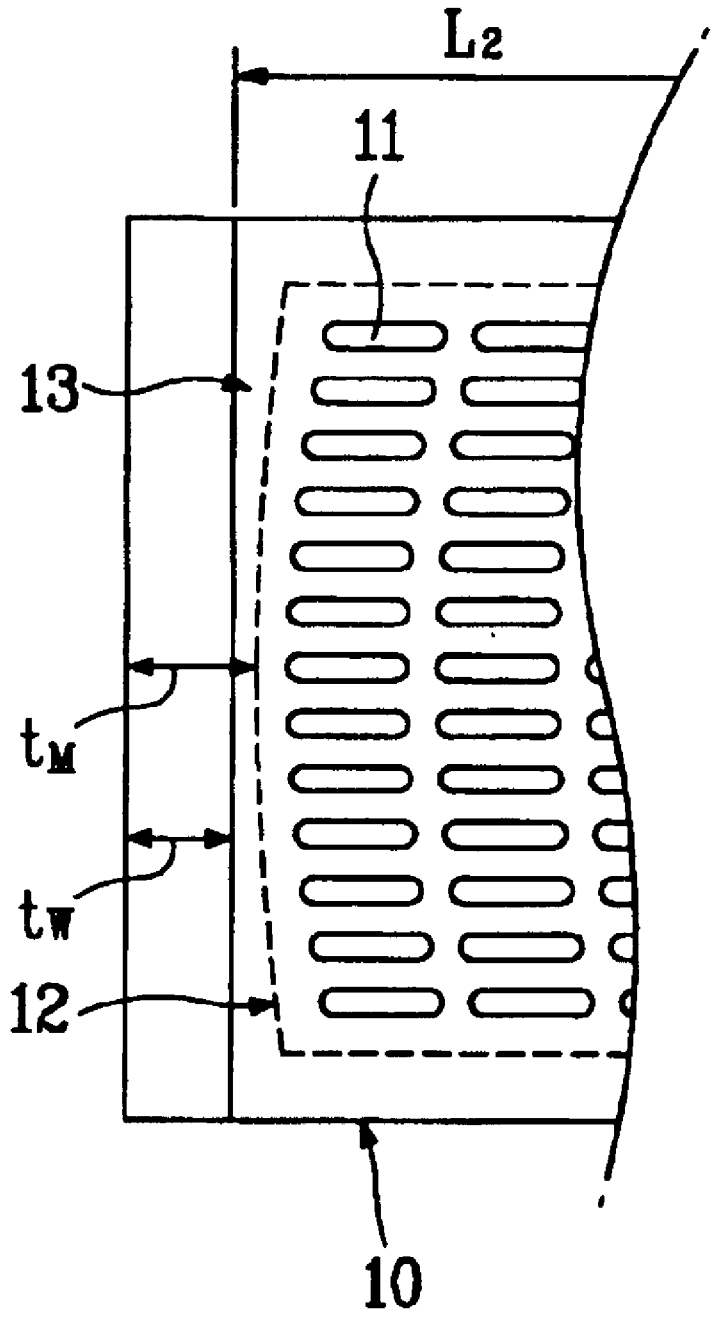
FIG. 3 is a plan view for partially showing the shadow mask assembly of the invention.

Also, as shown in FIG. 3, the shadow mask 10 includes an effective area 12 with the slots 11, which is represented with a dotted line, and a non-effective area 13 of peripheral region without slots for reinforcing the strength of the effective area 12.

Meanwhile, the frame structure for fixing the shadow mask 10 is formed of an iron with a large amount of thermal expansion coefficient, and includes a sub-frame 30 for tensioning the shadow mask 10 and a main frame **20*b* supported by the sub-frame 30** and directly welded to the shadow mask.

The main frame **20*b*** like this is designed based upon the principle according to equations which will be described hereinafter.

In other words, the main frame **20*b*** is required to tension the shadow mask so that the slots are spread into a predetermined width while maintaining a tensile force within the range that the slots may not be torn.

Therefore, as can be seen in Equation 1 and Equation 2, the relation between the natural frequency $\omega_n$ of the shadow mask and the tension side length L2 of the shadow mask or the length of the side of the shadow mask subject to tension is expressed according to Equation 1:

$$\omega_n = \pi \times \sqrt{\frac{T}{\rho L^2}} \qquad \text{Equation 1,}$$

herein, ρ is mass per unit length and T is tension applied to the tension side of the shadow mask.

Considering an equation for showing amplitude according to frequency, the relation of the tension side length and the amplitude of the shadow mask is expressed according to Equation 2:

$$X(t)=X_0 \times e^{-\xi \cdot \omega_n \cdot t} \times \sin(\omega_n \cdot t+\Phi) \qquad \text{Equation 2,}$$

herein, X(t) is amplitude, t is time, Φ is displacement and $X_0$ is amplitude of the initial shadow mask.

When Equation 1 is substituted into Equation 2, it will be expressed as in Equation 3:

$$X(t) \propto \rho \times L^2 \qquad \text{Equation 3,}$$

As can be seen in Equation 3, as the tension side length of the shadow is reduced, the amplitude of the shadow mask is decreased.

As the shadow mask is decreased in amplitude, a high natural frequency is constantly formed in the front of the shadow mask, which means tension is uniformly distributed in the tensioning direction and perpendicular direction as a resisting force against the tensile force for tensioning the shadow mask.

Therefore, in order to reduce the tension side length L2 of the shadow mask 10, the upper plane of the main frame **20*b*** is extended to the range that the influence of electron beam does not reach to form the mask welding width as $t_W$.

The welding width $t_W$ can be extended to the interface of the effective area and the non-effective area of the shadow mask, and the range thereof is defined about the shortest distance $t_M$ from the outermost end of the main frame of the shadow mask to the interface of the tension side effective area and the non-effective area of the shadow mask.

Also, when the growth of the welding width $t_W$ of the main frame increases stiffness of the main frame, and the mask welding width is defined within the range that does not interrupt the transmission of the electron beams through the shadow mask in the minimum range that can uniformly tension the shadow mask, it will be expressed as in Equation 4:

$$0.14 \le \frac{t_W}{t_M} \le 1.0 \qquad \text{Equation 4.}$$

The shadow mask is welded within the range of $0.5t_W$ to $t_W$ of the main frame so that the tension side length of the shadow mask may be efficiently reduced.

Figure 4A:
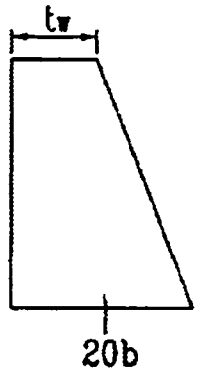
FIG. 4A to FIG. 4C are cross sectional views of various types of main frames of the invention which can be installed to the shadow mask shown in FIG. 3.
Figure 4B:
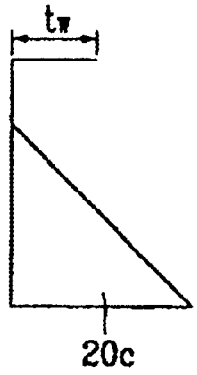
Figure 4C:
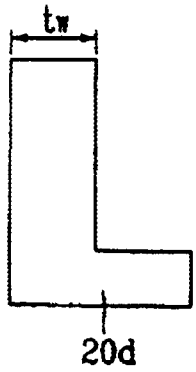

The shape of the main frame of the invention according to the foregoing description is as shown in FIG. 4A to FIG. 4C.

Referring to FIG. 4A, the main frame **20*b*** according to the invention has the mask welding width $t_W$ formed in the upper plane at a certain interval, and has a certain slope in the side inward about the shadow mask to have the side cross section shaped as a trapezoid.

Referring to FIG. 4B, the main frame **20*c*** is made of a plate, in which the upper part is bent to have the mask welding width $t_W$, and the lower part is perpendicular to the upper part and has one end bent parallel with the mask welding width and the other end bent again to closely contact with the perpendicular part, so that the side cross section of the main frame is shaped as a triangle.

Also referring to FIG. 4C, the main frame **20*d*** is inwardly bent at a middle portion of the frame which is uniformly formed with the mask welding width $t_W$ along the length, and formed with the same length as the short side of the shadow mask in the y-axis direction.

In the shadow mask assembly having the configuration like this, the welding width $t_W$ the shadow mask and the main frame ranges as in Equation 5:

$$0.30 \le \frac{t_M}{t_W} \le 0.99 \qquad \text{Equation 5.}$$

The shadow mask and the main frame are welded in the above range to reduce the tension side length of the shadow mask.

Figure 5:
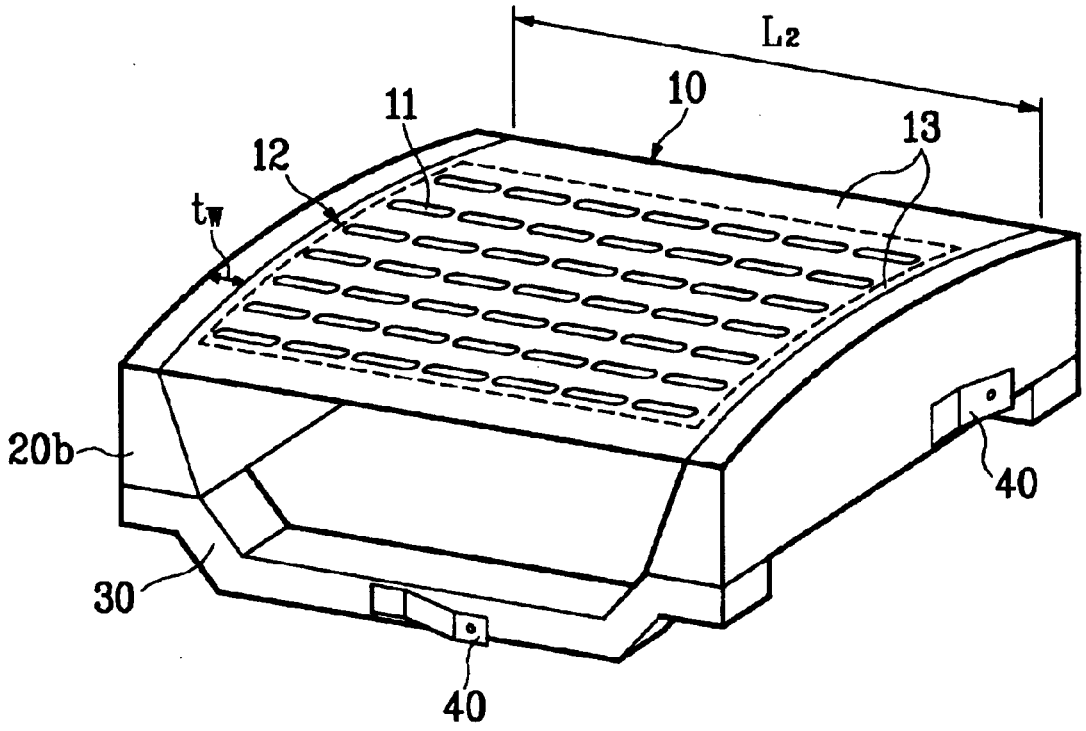
FIG. 5 is a perspective view for showing the shadow mask assembly installed in the flat color CRT shown in FIG. 2.

Referring to FIG. 5, the main frame **20*b* and the sub-frame 30**, which are determined according to the size of the CRT, are welded to form the quadrangular frame structure as the first process of coupling the frame and the tension shadow mask into the shadow mask assembly.

Also, when the sub-frame 30 is bent as a certain force is applied to both sides of the main frame **20*b*, the upper plane of the main frame and the long side outermost end of the shadow mask 10** are welded after aligned.

Then, when the force is released from the main frame, the sub-frame tensions the shadow mask 10 with a certain tension while returning to the original position due to elasticity.

Therefore, the main frame with enlarged welding width according to the invention is strained in a smaller amount due to increased stiffness, and thus tensions the shadow mask with a constant tensile force.

Then, the amount of strain is substantially the same across the whole surface so that the natural frequency is also uniform to reduce the range of amplitude.

Also, while the tension side length of the shadow mask has the interval L1 (as shown in FIG. 1) in the related art, the length has the interval L2 (as shown in FIG. 3) in the invention with the reduced length so that the shadow mask is uniformly formed across the whole surface with high natural frequency.

The shadow mask assembly described hereinbefore, in which the center of each side of the frame is fixedly welded with a spring 40 having a through hole, is fixed at the rear of the panel for allowing the electron beams to pass.

Meanwhile, as another embodiment of the invention, a rail as the frame is fixed along each rear side of the panel with frit glass, and the shadow mask with slot is welded to the rear surface of the rail.

Also, according to the shortest distance $t_M$ from the outermost end of the rail to the interface of the effective area and the non-effective area, the rail has the welding width as much as $t_W$ in the range of $$0.14 \le \frac{t_W}{t_M} \le 1.0,$$

which is obtained from Equation 4.

Here, the shadow mask is welded to the rear surface of the rail in the range of $t_W/2$ to $t_W$.

Therefore, the shadow mask is fixed to the frame with constant tension and short in the tension side length to narrow the extent of amplitude so that the electron beams may land at the phosphor dots without any displacement of slot positions.

Therefore, according to the present invention as described hereinbefore, as the welding width of the main frame is increased, the tension side length is reduced to reduce the natural frequency amplitude range thereby preventing howling and enhancing definition.

Also, the vibration range capable of avoiding howling is expanded due to amplitude range decrease of the shadow mask so that the vibration range of other parts used in the CRT can be easily selected.

Furthermore, since the frame is enhanced in stiffness, strain of the frame is decreased, the welding operation with the shadow mask is easy, and productivity is enhanced.

Meanwhile, it will be understood to those skilled in the art that the welding width range and the like of the main frame can be variously changed according to the features of the shadow mask and the invention can be applied regardless of the shape of the main frame.

What is claimed is:

1. A shadow mask assembly, comprising:

a shadow mask having an effective area and a non-effective area; and a frame fixing body configured to tension said shadow mask, wherein a shortest distance $t_M$ from an outermost end of a main frame welded to said shadow mask to an interface between the effective area and the non-effective area and a width $t_W$ of a mask welding part formed at an upper part of said main frame satisfy the following equation:

$$0.14 \le \frac{t_W}{t_M} \le 0.5.$$

2. The shadow mask assembly according to claim 1, wherein said shadow mask is welded to the outermost end of said main frame along an effective area side direction within a range of $t_W/2$ to $t_W$.

3. The shadow mask assembly according to claim 1, wherein the upper part of the main frame comprises the welding part width $t_W$ and one side of the mainframe is inwardly sloped toward said shadow mask so that a side cross section of the main frame has upper and lower surfaces parallel to each other.

4. The shadow mask assembly according to claim 1, wherein said main frame is made of a plate, of which the upper part is bent to form the mask welding part having the width $t_W$ and the lower part extends perpendicular to the upper part and has one end bent parallel to the mask welding part and the other end bent again to closely contact with the perpendicular part to form a slope inward to said shadow mask.

5. A cathode ray tube comprising the shadow mask assembly of claim 1.

6. The shadow mask assembly according to claim 1, wherein the effective area comprises slots and the non-effective area is without slots.

7. The shadow mask assembly according to claim 6, wherein the non-effective area extends from a periphery of the effective area.

8. A shadow mask assembly comprising:

a rail forming a frame; and a shadow mask welded and tensioned at a rear surface of said rail, wherein a rear surface of said rail is defined by a width $t_W$ in a range of $$0.14 \le \frac{t_W}{t_M} \le 0.5,$$

wherein $t_M$ is a shortest distance from an outermost end of said rail to an interface between an effective area and a non-effective area of said shadow mask.

9. The shadow mask assembly according to claim 8, wherein said shadow mask is welded to the rear of said rail in a range of $t_W/2$ to $t_W$.

10. A cathode ray tube comprising the shadow mask assembly of claim 8.

11. The shadow mask assembly according to claim 8, wherein the effective area comprises slots and the non-effective area is without slots.

12. The shadow mask assembly according to claim 11, wherein the non-effective area extends from a periphery of the effective area.

* * * * *